US006592328B1

(12) United States Patent
Cahill

(10) Patent No.: US 6,592,328 B1
(45) Date of Patent: Jul. 15, 2003

(54) METHOD AND APPARATUS FOR ADJUSTING THE PITCH OF A FAN BLADE

(75) Inventor: Frank E. Cahill, Lenexa, KS (US)

(73) Assignee: Emerson Electric Co., St. Louis, MO (US)

( * ) Notice: Subject to any disclaimer, the term of this patent is extended or adjusted under 35 U.S.C. 154(b) by 281 days.

(21) Appl. No.: 09/836,831

(22) Filed: Apr. 17, 2001

(51) Int. Cl.[7] ..... F04D 29/36
(52) U.S. Cl. ..... 416/155; 416/214 R
(58) Field of Search ..... 416/36, 155, 214 R; 440/49, 50

(56) References Cited

U.S. PATENT DOCUMENTS

| | | | |
|---|---|---|---|
| 2,419,787 | A | 4/1947 | Muffly |
| 2,421,692 | A | 6/1947 | Hackethal |
| 2,423,752 | A | 7/1947 | Biermann |
| 2,504,559 | A | 4/1950 | Martin et al. |
| 2,612,229 | A | 9/1952 | Tornes et al. |
| 2,835,331 | A | 5/1958 | Ryan et al. |
| 2,850,106 | A | 9/1958 | Swan |
| 3,282,351 | A | 11/1966 | Troutman |
| 3,295,610 | A | 1/1967 | Frlas |
| 3,512,005 | A | 5/1970 | Bawduniak |
| 3,795,463 | A | 3/1974 | Herbert |
| 3,853,427 | A | 12/1974 | Holt |
| 3,958,897 | A | 5/1976 | Connolly |
| 3,967,916 | A | 7/1976 | Chittom |
| 3,994,128 | A | 11/1976 | Griswold, Jr. et al. |
| 4,047,838 | A | 9/1977 | Ferris et al. |
| 4,347,039 | A | 8/1982 | Houghton |
| 4,364,708 | A | 12/1982 | David |
| 4,545,734 | A | 10/1985 | Schilder |
| 4,591,313 | A | 5/1986 | Miyatake et al. |
| 4,619,586 | A | 10/1986 | Carter |
| 4,662,819 | A | 5/1987 | Lakowske et al. |
| 4,704,067 | A | 11/1987 | Fisher |
| 4,732,538 | A | 3/1988 | Wollenweber et al. |
| 4,738,591 | A | 4/1988 | Butler |
| 4,741,672 | A | 5/1988 | Breuner |
| 4,767,270 | A | 8/1988 | Seidel |
| 4,810,164 | A | 3/1989 | Wright |
| 4,842,484 | A | 6/1989 | Johnson |
| 4,913,623 | A | 4/1990 | Schilling et al. |
| 4,927,329 | A | 5/1990 | Kliman et al. |
| 5,022,821 | A | 6/1991 | Isert |
| 5,090,869 | A | 2/1992 | Wright |
| 5,122,034 | A | 6/1992 | Isert |
| 5,152,668 | A | 10/1992 | Bulman et al. |
| 5,154,580 | A | 10/1992 | Hora |
| 5,156,648 | A | 10/1992 | Hora |
| 5,213,471 | A | 5/1993 | Miller et al. |
| 5,242,265 | A | 9/1993 | Hora et al. |
| 5,299,911 | A | 4/1994 | Moriya |
| 5,464,324 | A | 11/1995 | Langenberg |
| 5,498,135 | A | 3/1996 | Stallard, III |
| 6,109,871 | A | 8/2000 | Nelson et al. |

*Primary Examiner*—Edward K. Look
*Assistant Examiner*—Kimya N McCoy
(74) *Attorney, Agent, or Firm*—Hovey Williams LLP

(57) ABSTRACT

A variable pitch fan blade assembly includes a hub, a pitch-adjusting assembly, a fan blade, and an actuator. The pitch-adjusting assembly includes a first element rotatable on a first axis and a second element rotatable on a second axis. The first element presents an elongated pitch pin. The second element defines an elongated pitch slot receiving the pitch pin. The fan blade is coupled to one of the elements for rotation therewith. The actuator is coupled to the other of the elements for rotation therewith. When the actuator rotates the element to which it is coupled, the element to which the fan blade is coupled is rotated via the pin/slot arrangement, thereby adjusting the pitch of the fan blade.

39 Claims, 6 Drawing Sheets

METHOD AND APPARATUS FOR ADJUSTING THE PITCH OF A FAN BLADE

BACKGROUND OF THE INVENTION

1. Field of the Invention

The present invention relates generally to variable pitch fans. More specifically, the present invention concerns a system for simultaneously adjusting the pitch of a plurality of fan blades attached to a common hub.

2. Discussion of Prior Art

Variable pitch fans are useful for a variety of applications such as, for example, commercial and industrial ventilation. Most ventilation fans are powered by electric motors. When fixed-blade ventilation fans are employed for commercial or industrial ventilation, the electric motor must typically either be switched on and off periodically or the speed of the electric motor must be adjusted as ventilation requirements vary due to environmental conditions. Periodically switching ventilation fans on and off is undesirable because it shortens the life of the electric motor. Further, periodically switching ventilation fans on and off does not continuously maintain the ventilated environment at a desired condition; rather, the ventilated environment is frequently in either an over-ventilated or under-ventilated state. Varying the speed of ventilation fans is undesirable because most electric motors have an optimum operating speed at which they are most efficient. Varying the speed of the electric motor above or below this optimal operating speed causes inefficiencies.

It is known that varying the pitch of propeller blades allows the drive motor to continuously operate at an optimum speed while adjusting for changes in output requirements. Although many systems exist today for varying the pitch of propeller blades such as, for example, variable pitch aircraft propellers, existing systems are typically too expensive, too complicated, and/or too bulky to be used for ventilation applications.

SUMMARY OF THE INVENTION

In accordance with an embodiment of the present invention, a pitch adjusting assembly is provided. The pitch adjusting assembly includes a first element presenting an elongated pin and a second element defining an elongated slot. The pin is movable about a first element axis and the slot is movable about a second element axis. The element axes are oriented substantially perpendicular to one another. The pin extends at least substantially parallel to one of the axes and the slot is elongated at least substantially parallel to the other of the axes. The slot receives the pin at a location offset from both axes.

In accordance with another embodiment of the present invention, a variable pitch fan blade assembly is provided. The variable pitch fan blade assembly includes a hub, a pitch adjusting assembly, a fan blade, and an actuator. The pitch-adjusting assembly is supported by the hub and includes a first element rotatable on a first axis and a second element rotatable on a second axis. The first element presents an elongated pitch pin. The second element defines an elongated pitch slot offset from the first and second axes. The pitch slot receives the pitch pin so that rotation of one of the elements causes rotation of the other of the elements. The fan blade is coupled to one of the elements. The actuator is coupled to the other of the elements.

In accordance with another embodiment of the present invention, a variable pitch fan blade assembly is provided.

The fan blade assembly comprises a hub adapted for rotation on a hub axis and a fan blade pivotally coupled to the hub. The hub comprises a housing and a pitch wheel disposed within the housing. The housing is adapted to rotate on the hub axis and the pitch wheel is adapted to rotate relative to the housing on a pitch wheel axis. The fan blade is adapted to rotate with the housing around the hub axis. The fan blade is further adapted to rotate relative to the housing on a blade axis which is substantially perpendicular to the hub axis. The fan blade has a protruding pitch pin offset relative to the blade axis. The pitch pin is received in a slot in the pitch wheel. When the pitch wheel is rotated relative to the housing the fan blade is rotated on the blade axis, thereby adjusting the pitch of the fan blade.

In accordance with an embodiment of the present invention, a method of simultaneously varying the pitch of a plurality of fan blades using an actuator is provided. The method comprises (a) coupling a fan blade to a first element rotatable on a first axis; (b) coupling an actuator to a second element rotatable on a second axis; (c) inserting an elongated pin presented by one of the elements into an elongated slot presented by the other of the elements; (d) positioning the first and second elements so that the first and second axes are at least substantially perpendicular to one another; and (e) actuating the actuator to rotate the second element and thereby cause rotation of the blade.

The system of the present invention has the advantage of simultaneously adjusting the pitch of a plurality of fan blades. The system of the present invention has the further advantage of a relatively simple and inexpensive design. The system of the present invention has a still further advantage of being easily scalable for implementation in a wide variety of applications. The system of the present invention has an even further advantage of being substantially self-contained so that it can easily be used to replace existing fan blade assemblies without substantial modifications to the existing system. Other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 2:
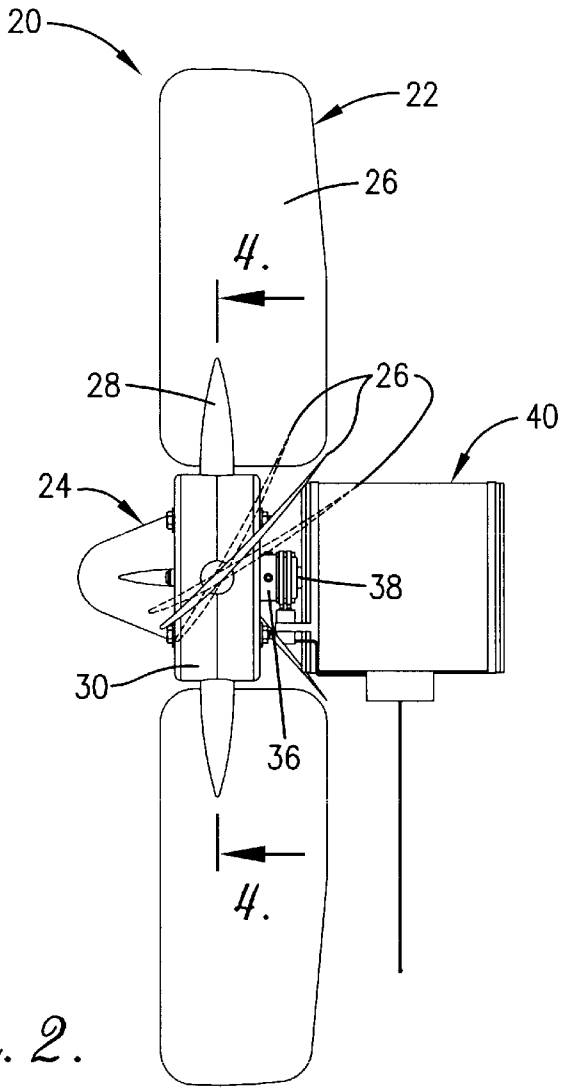
FIG. 2 is a side view of a variable pitch fan blade assembly connected to a motor.
Figure 1:
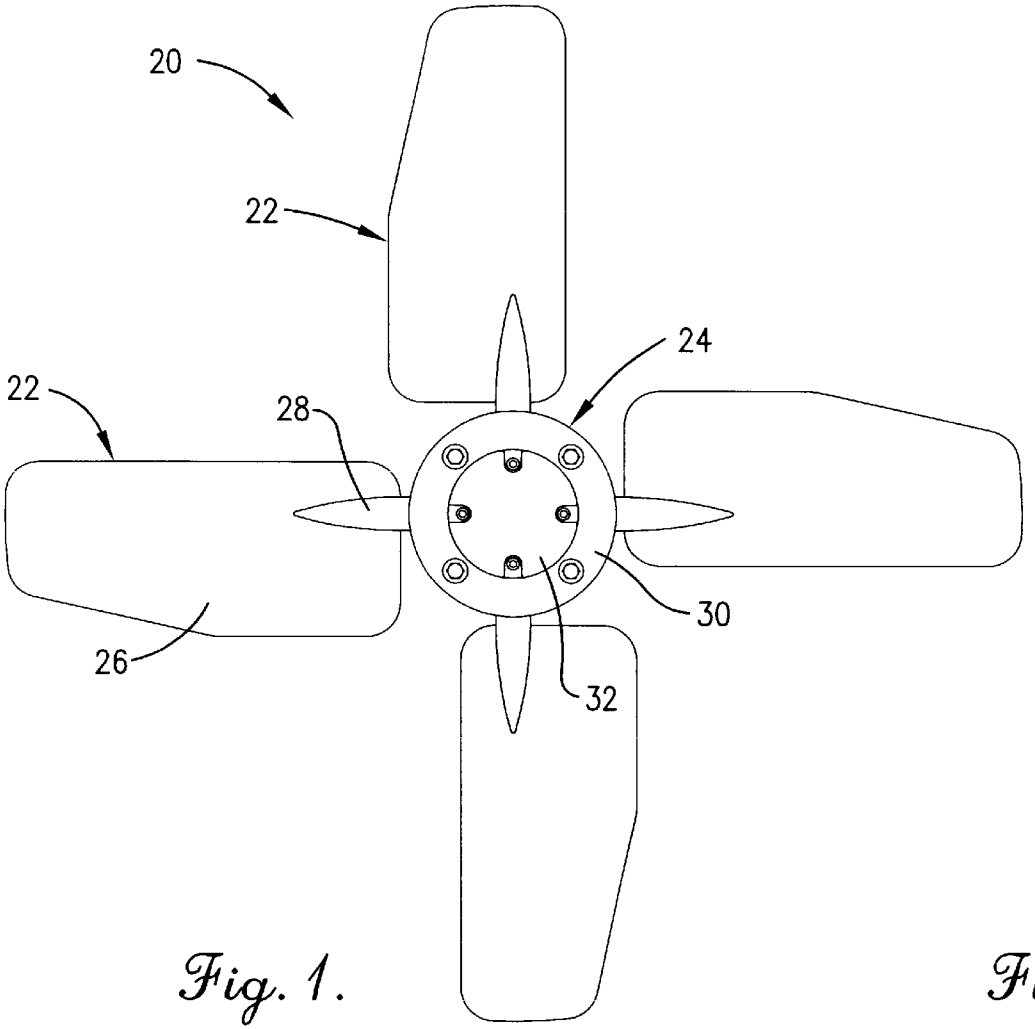
FIG. 1 is a front view of a variable pitch fan blade assembly constructed in accordance with the principles of the present invention.

Turning initially to FIGS. 1 and 2, the variable pitch fan blade assembly 20 selected for illustration generally includes a plurality of blades 22 coupled to a hub assembly 24. Each blade 22 has a vane 26 and a base 28. The hub assembly 24 comprises a housing 30 and a nose cap 32. Each blade 22 is coupled to housing 30 via base 28.

As best shown in FIG. 2, a hub coupling 36 secures the variable pitch fan blade assembly 20 to a rotatable drive shaft 38 of a drive motor 40. When drive motor 40 rotates drive shaft 38, hub assembly 24 and blades 22 rotate, thereby displacing a fluid which contacts vanes 26. The dashed lines in FIG. 2 further illustrate that base 28 is rotatably coupled to housing 30 so that the pitch of vanes 26 can be varied, as described in detail below.

Figure 3:
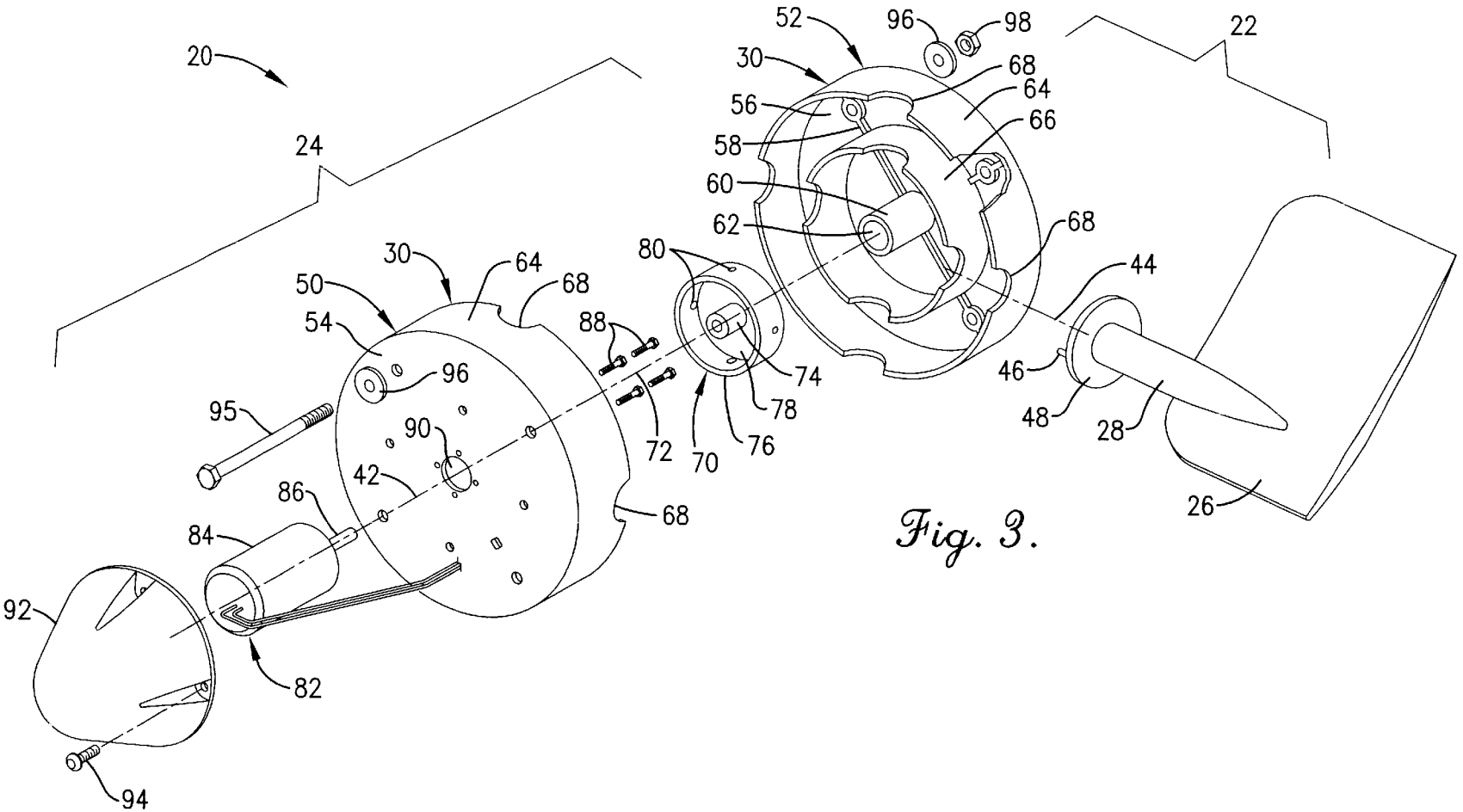
FIG. 3 is an exploded view of a variable pitch fan blade assembly.

FIG. 3 is an exploded view of variable pitch fan blade assembly 20 showing specific components of hub assembly 24 and blades 22. Hub assembly 24 is designed to rotate on a hub axis 42. Blades 22, being coupled to hub assembly 24, rotate along with hub assembly 24 around hub axis 42. Blades 22 further rotate relative to hub assembly 24 on a blade axis 44.

Blade 22 has an eccentric pitch pin 46 mounted on a pin support 48 which is secured to base 28. Base 28 is preferably an elongated cylindrical member having a longitudinal axis which corresponds to blade axis 44. Pin support 48 is preferably a cylindrical disk coupled to the terminal end of base 28. Pitch pin 46 preferably protrudes from pin support 48 in a direction which is substantially parallel to blade axis 44. Pitch pin is preferably offset from blade axis 44 so that movement of pitch pin 46 around blade axis 44 causes rotation of blade 22 on blade axis 44.

A housing 30 of hub assembly 24 is preferably a split-housing having a hubcap 50 and a hub core 52. Hubcap 50 has a disk-shaped front plate 54 and hub core 52 has a disk-shaped back plate 56. Back plate 56 comprises reinforcement ribs 58 and hub coupling 60. Hub coupling 60 has a bore 62 for receiving a rotatable drive shaft. Back plate 56 and front plate 54 each have a matching pair of outer rings 64 and inner rings 66 extending therefrom. Outer rings 64 and inner rings 66 of front plate 54 and back plate 56 each have corresponding semi-circular notches 68. When housing 30 is assembled, it has a generally cylindrical shape and can be rotated on hub axis 42.

A pitch wheel 70 of hub assembly 24 is disposed within housing 30. Preferably, pitch wheel 70 is disposed within inner ring 66. Pitch wheel 70 is rotatable relative to housing 30 on a pitch wheel axis 72. Preferably, pitch wheel axis 72 has substantially the same orientation as hub axis 42. Pitch wheel 70 generally comprises a pitch wheel hub 74 and a rim 76 connected by a disk 78. Rim 76 is preferably annular cylindrical in shape and has a plurality of slots 80 extending inward from the outer radial surface of rim 76. Preferably, slots 80 extend completely through rim 76. Slots 80 are configured to receive pitch pins 46 and to restrict the rotation of pitch pins 46 about blade axis 44. Slots 80 are preferably elongated in a direction which is substantially parallel to pitch wheel axis 72. Slots 80 are at least partially defined by opposing, substantially parallel edges. The space between the opposing edges (i.e., the width of slot 80) is preferably marginally greater than the diameter of pitch pins 46 so that pitch pins 46 can be received in slots 80 but restrained from free movement about blade axis 44. The length of slots 80 depends on the desired variation in the pitch angle of vane 26. The length of slots 80 must be sufficient to allow pitch pins 46 to travel a distance parallel to pitch wheel axis 72 as pitch pin 46 is rotated about blade axis 44.

A power actuator 82 can be employed to rotate pitch wheel 70. Power actuator 82 preferably comprises an electric pitch motor 84, such as a servomotor, and a rotatable pitch drive shaft 86. Pitch motor 84 is secured to front plate 54 by any means known in the art such as, for example, machine screws 88. Pitch drive shaft 86 extends through a hole 90 in front plate 54 and is secured to pitch wheel hub 74 by any means known in the art such as, for example, a set screw. Power actuator 82 is protected from the external environment by a nose cap 92. Nose cap 92 encloses power actuator 82 and can be secured to front plate 54 by any means known in the art such as, for example, machine screws 94.

To assemble variable pitch fan blade assembly 20 illustrated in FIG. 3, pitch drive shaft 86 is extended through opening 90 and power actuator 82 is secured to housing 30 by machine screws 88. Pitch wheel hub 74 can then be secured to pitch drive shaft 86. Slots 80 can then be aligned with semi-circular notches 68 in hubcap 50 so that pitch pin 46 can be received in a respective slot 80 while base 28 is placed in semi-circular notches 68. Hubcap 50 and hub core 52 can then be aligned so that semi-circular notches 68 of hubcap 50 and hub core 52 create a shaft receiving opening in which base 28 is received. Hubcap 50 and hub core 52 can then be secured together by any means known in the art such as, for example, bolt 95, washers 96, and nut 98. Nose cap 92 can then be placed over power actuator 82 and secured to housing 30 by machine screws 94.

Figure 5:
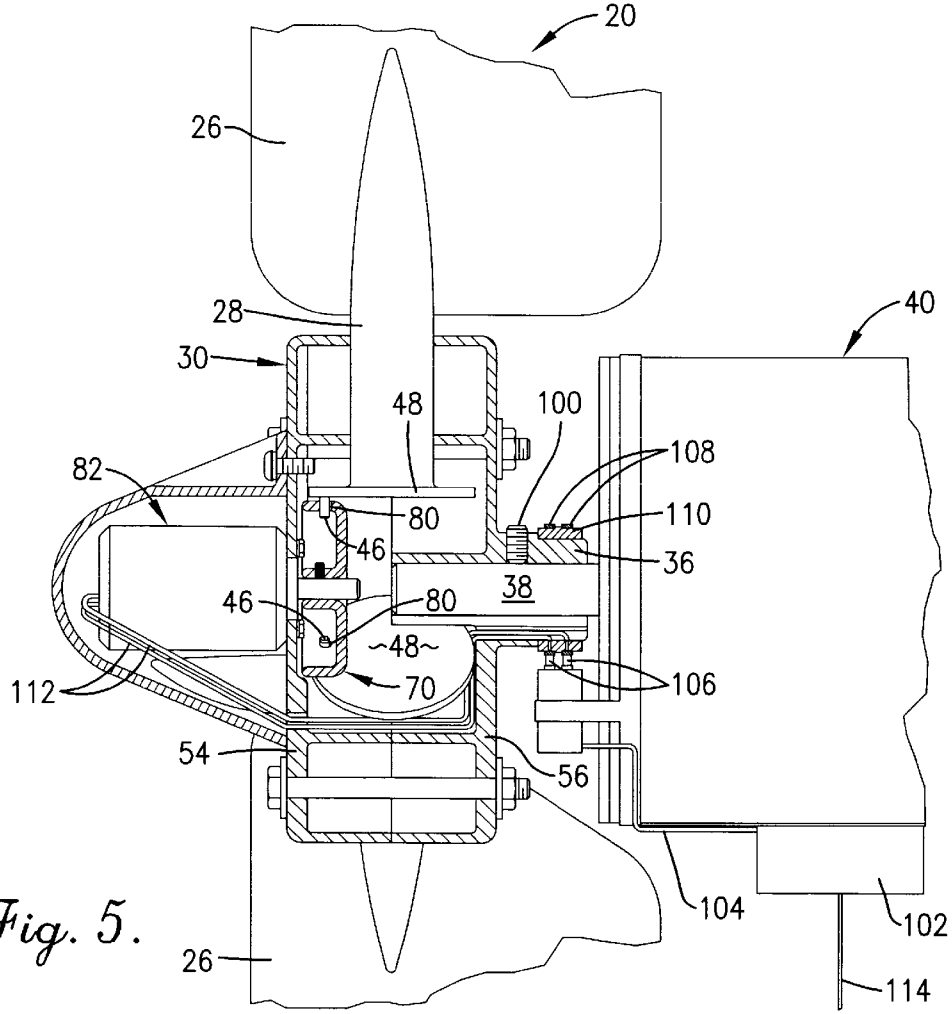
FIG. 5 is a sectional view of a variable pitch fan blade assembly taken along line 5—5 in FIG. 4.
Figure 4:
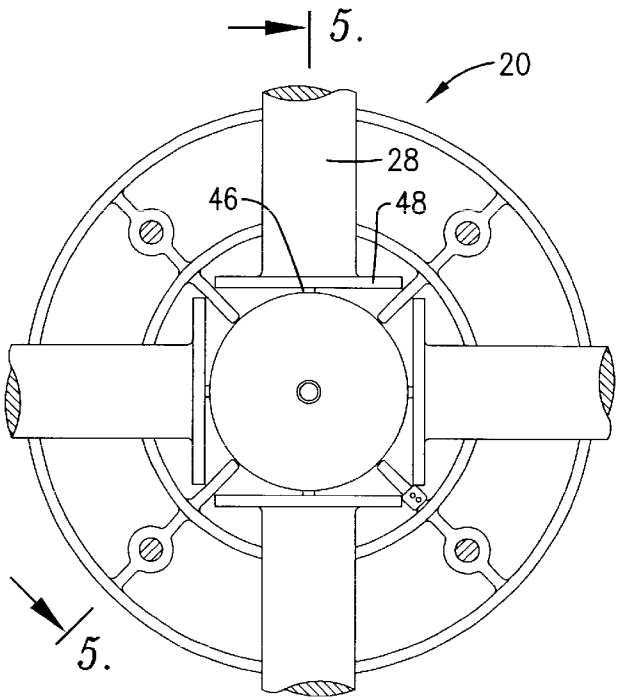
FIG. 4 is a sectional view of a variable pitch fan blade assembly taken along line 4—4 in FIG. 2.

FIGS. 4 and 5 are sectional views of assembled variable pitch fan blade assembly 20 showing the positioning of base 28, pitch pin 46, and pin support 48 in hub assembly 24. FIG. 5 shows the positioning of variable pitch fan assembly 20 relative to drive motor 40. Hub coupling 36 can be secured to drive shaft 38 by a set screw 100. Power actuator 82 can be powered and controlled by a controller 102 which is located remotely from variable pitch fan blade assembly 20. Controller 102 emits an electrical signal which is conducted by wires 104 to brushes 106. Brushes 106 maintain contact with conductor rings 108 mounted on hub coupling 36, thereby transmitting the electrical signal from wires 104 to conductor rings 108. Conductor rings 108 are insulated from hub coupling 36 by insulation ring 110. Leads 112 are electrically connected to conductor rings 108 and carry the electrical signal from conductor rings 108, through apertures in back plate 56 and front plate 54, to power actuator 82.

Controller 102 can be any device capable of controlling an electric signal charged to power actuator 82. Preferably, controller 102 can receive a remote signal via an antenna 114. Controller 102 is preferably positioned remotely from variable pitch fan blade assembly 20. Most preferably, controller 102 is mounted on drive motor 40.

Referring now to FIGS. 3 and 5, in operation the pitch of a plurality of vanes 26 can be simultaneously adjusted by actuating power actuator 82 to thereby rotate pitch wheel 70. The rotation of pitch wheel 70 causes the edges of slots 80 to press against pitch pins 46 and force pitch pins 46 to move relative to blade axis 44. The movement of pitch pins 46 relative to blade axis 44 causes pin support 48 and base 28 to rotate on blade axis 44 relative to housing 30, thereby changing the pitch of vanes 26. Preferably, power actuator 82 is capable of incrementally rotating and holding pitch wheel 70 in a plurality of pitch positions, thereby allowing the pitch of vanes 26 to be selectively, simultaneously, and incrementally adjusted.

The embodiment illustrated in FIGS. 1–5 allows the pitch of blades 22 to be adjusted while the variable pitch fan blade assembly 20 is resting or while variable pitch fan blade assembly 20 is being rotated by drive motor 40. The ability of the variable pitch fan blade assembly of this embodiment to simultaneously adjust the pitch of a fan blade while the fan is rotating makes it particularly useful for ventilation applications. Because the blade pitch of the inventive fan blade assembly can be remotely adjusted, a plurality of ventilation fans can be controlled from a central location. Therefore, in a preferred ventilation system, a plurality of ventilation fans are placed in ventilation apertures in a ventilated enclosure, such as a building. A plurality of sensors can be employed to measure various conditions (e.g., flow rate, temperature, and/or pressure) at various locations within the ventilated enclosure. The output from these sensors can be fed to a central control system. The control system can be programmed with predetermined upper and lower ventilation parameters. If the sensor inputs indicate a ventilated state which is within the preset upper and lower ventilation parameters, no pitch adjusting signal is emitted. However, if the sensor inputs indicate a ventilated state which is above the upper preset parameter or below the lower preset parameter, the control system can send a compensating pitch adjustment signal to any or all of the ventilation fans. The pitch adjustment signals can be received and processed by the ventilation fans to thereby adjust the pitch of the fan blade to maintain the environment within the enclosure in a desired condition. In such a configuration, the ventilated enclosure can be continuously maintained in a desired ventilated state while the motors of the ventilation fans are continuously operated at their optimum efficiency speed.

FIGS. 6–12 illustrate an alternative embodiment of the present invention in which the pitch of a plurality of blades are simultaneously adjusted using a manual actuating force. Because many of the components of the variable pitch fan blade assembly described in this embodiment are substantially the same as those described in,the previous embodiment, the variable pitch fan blade assembly illustrated in FIGS. 6–12 will be described primarily with respect to the differences between this embodiment and the previously described embodiment.

Figure 7:
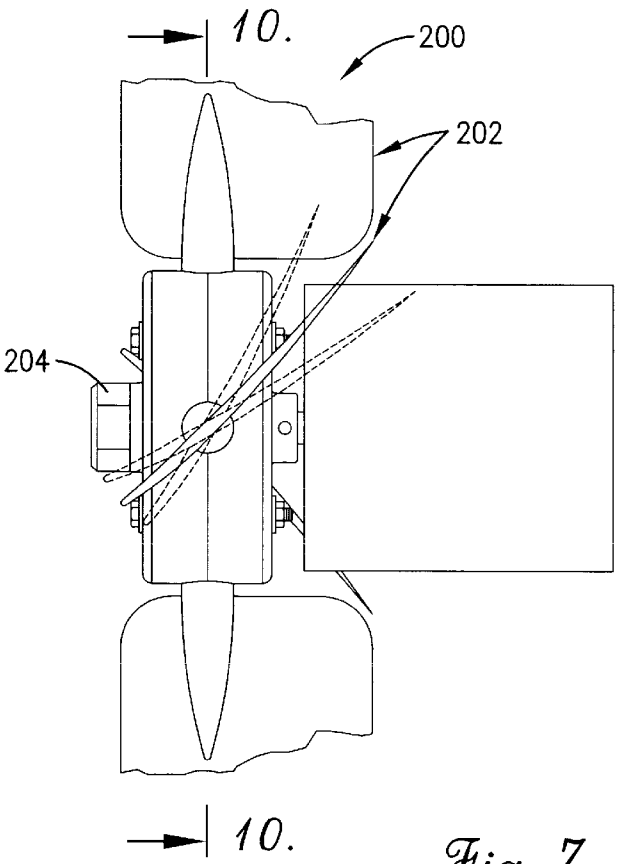
FIG. 7 is a side view of a variable pitch fan blade assembly connected to a motor.
Figure 6:
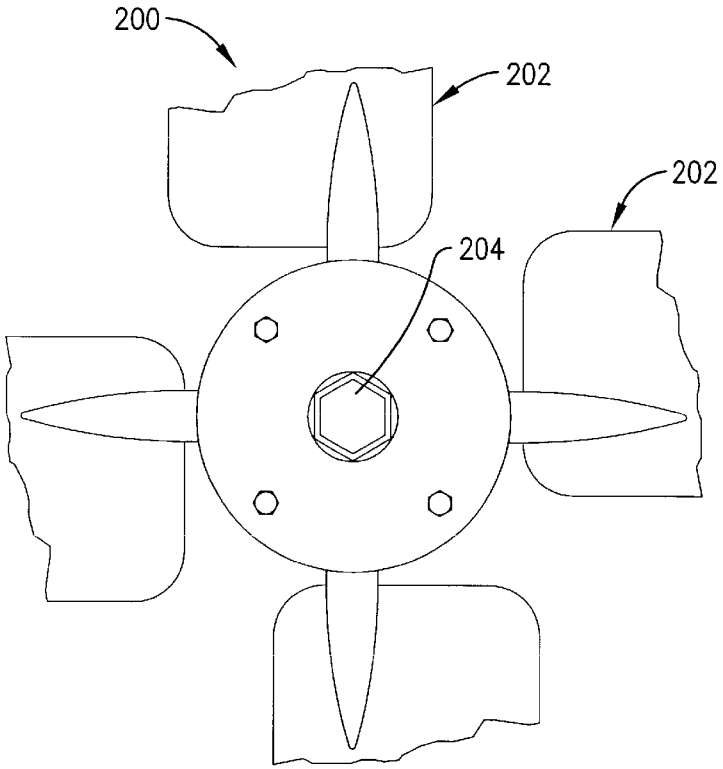
FIG. 6 is a front view of a variable pitch fan blade assembly constructed in accordance with the principles of the present invention.
Figures 8, 9:
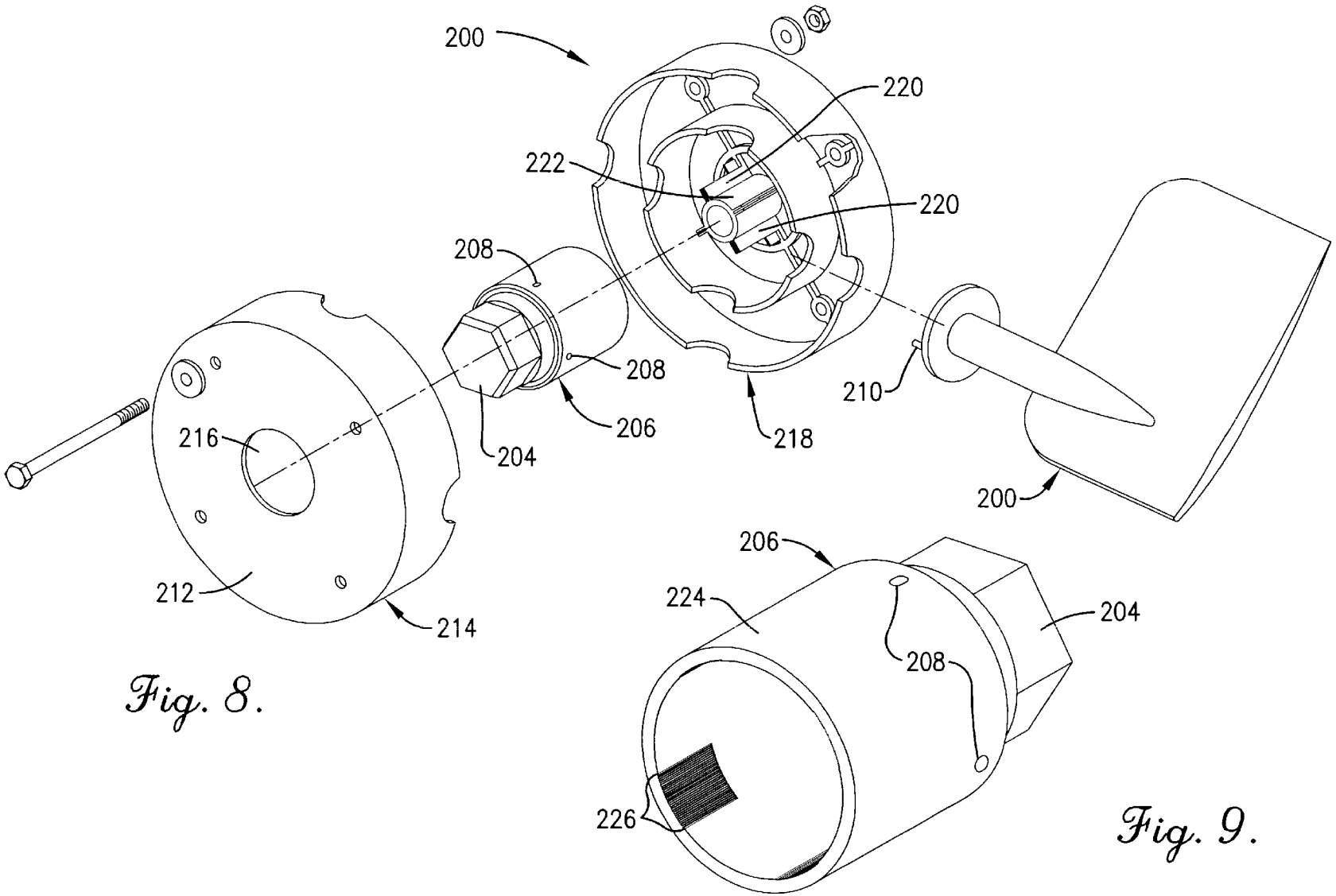
FIG. 8 is an exploded view of a variable pitch fan blade assembly.
FIG. 9 is an isometric view of a pitch wheel showing the pitch notches.

Referring now to FIGS. 6 and 7, a variable pitch fan blade assembly 200 allows the pitch of fan blades 202 to be adjusted by manually turning a gripping device 204. As shown in FIG. 8, gripping device 204 is fixedly coupled to a pitch wheel 206. Pitch wheel 206 has a plurality of slots 208 which receive a respective pitch pin 210. A front plate 212 of a hubcap 214 includes a hole 216 through which gripping device 204 extends. A hub core 218 includes pawl seats 220 which are attached to a hub coupling 222.

Figure 11:
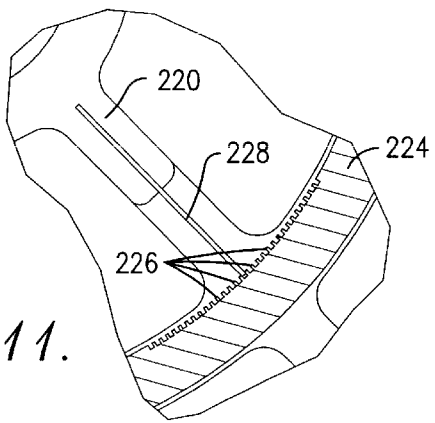
FIG. 11 is a close-up view showing the details of a spring pawl.
Figure 10:
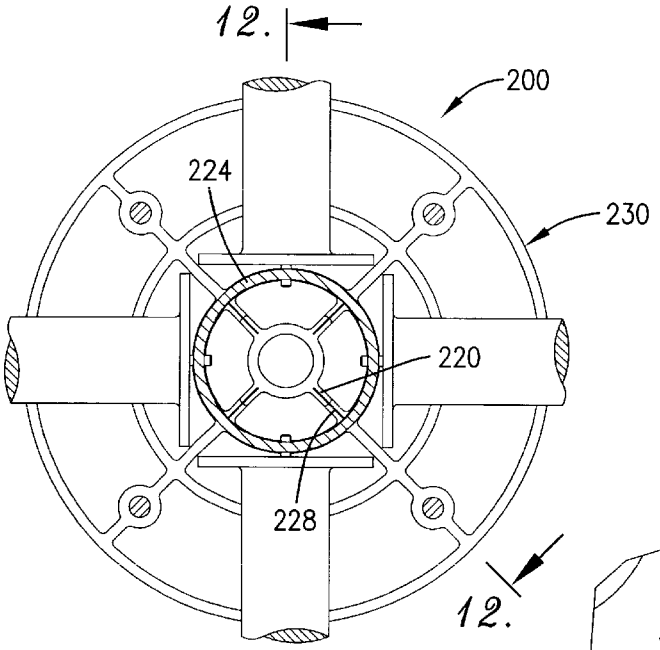
FIG. 10 is a sectional view of a variable pitch fan blade assembly taken along line 10—10 in FIG. 7.

FIG. 9 shows that a rim 224 of pitch wheel 206 includes pitch notches 226 on its inner surface. FIGS. 10 and 11 show that a spring pawl 228 has a first end which is secured to pawl seat 220 and a second end which is received in pitch notches 226. Spring pawl 228 is preferably composed of a resilient material which is stiff enough to provide pitch wheel 206 with resistance to rotation relative to a housing 230, but flexible enough to be shifted from one pitch notch 226 into an adjacent pitch notch 226 when a sufficient torsional force is applied to gripping device 204.

Figure 12:
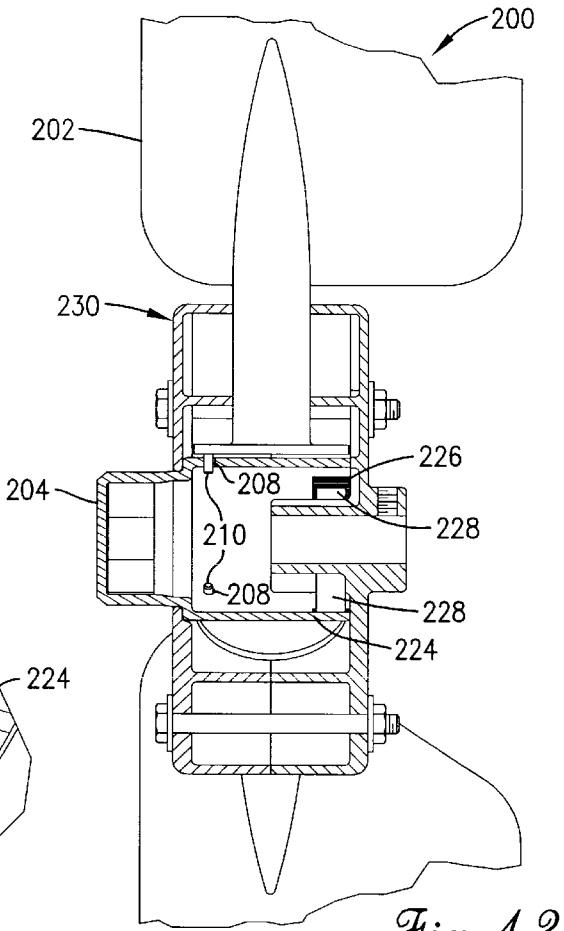
FIG. 12 is a sectional view of a variable pitch fan blade assembly taken along line 12—12 in FIG. 10.

Referring now to FIGS. 10–12, in operation the pitch of blades 202 can be simultaneously adjusted by applying a sufficient torsional force to gripping device 204 so that the resistance to rotation of pitch wheel 206 relative to housing 230 provided by spring pawl 228 is overcome. Pitch wheel 206 can be incrementally rotated and held in a plurality of pitch positions, thereby allowing the pitch of blades 202 to be selectively, simultaneously, and incrementally adjusted.

Although in the preferred embodiment of the present invention the pitch pins are described as being coupled to the fan blade and the pitch slots are described as being coupled to the actuator, it should be understood that other pin/slot configurations may be employed. For example, the pitch pin may be coupled for rotation with the actuator and received in a slot which is coupled for rotation with the fan blade. Regardless of the specific pin/slot configuration, it is preferred that the pin/slot interface be offset from both the axis of rotation of the actuator and the axis of rotation of the fan blade so that rotation of one of the elements coupled to the pin or slot causes rotation of the other of the elements coupled to the pin or slot. Further, it is preferred that the slot be elongated along a common plane defined by the axes of rotation of the actuator and the fan blade. Elongation of the slot in this manner allows the pin to travel within the slot as the pin and slot are rotated on independent axes of rotation. The width of the elongated slot is preferably only marginally greater than the width of the pin so that when the actuator is restrained from rotation relative to the hub, the fan blade is also substantially restrained from rotation relative to the hub.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A pitch adjusting assembly for varying the pitch of a fan blade coupled to a hub, said hub rotatable on a hub axis, said fan blade rotatable relative to the hub on a blade axis, said pitch adjusting assembly comprising:

a first element rotatable on a first element axis and presenting an elongated pin; and a second element rotatable on a second element axis and defining an elongated slot, said pin movable about the first element axis and said slot movable about the second element axis, said element axes being at least substantially perpendicular to one another, said pin extending at least substantially parallel to one of the axes, said slot elongated at least substantially parallel to the other of the axes, said slot receiving the pin at a location offset from both of the axes.

2. A pitch adjusting assembly as claimed in claim 1, said slot at least partially defined by a pair of opposing substantially parallel edges, said edges spaced to at least substantially prevent relative edgewise movement of the pin within the slot.

3. A pitch adjusting assembly as claimed in claim 1, said first and second elements adapted to be disposed within the hub, said first and second elements adapted to be at least substantially restrained from translation relative to the hub.

4. A pitch adjusting assembly as claimed in claim 1, one of said elements being couplable to the fan blade for rotation therewith on the blade axis.

5. A pitch adjusting assembly as claimed in claim 4; and an actuator coupled to the other of said elements for rotation therewith on an actuator axis.

6. A pitch adjusting assembly as claimed in claim 5, said actuator coupled to the hub for rotation therewith on the hub axis, said actuator at least partially rotatable relative to the hub on the actuator axis.

7. A pitch adjusting assembly as claimed in claim 6, said blade axis and said actuator axis being substantially perpendicular to one another.

8. A pitch adjusting assembly as claimed in claim 7, one of said element axes having an orientation which at least substantially corresponds to the orientation of the blade axes, the other of said element axes having an orientation which at least substantially corresponds to the orientation of the actuator axis.

9. A pitch adjusting assembly as claimed in claim 8, said actuator adapted to be manually rotatable relative to the hub.

10. A pitch adjusting assembly as claimed in claim 9; and a resilient spring pawl adapted to be coupled between the hub and one of the elements, said spring pawl adapted to provide resistance to rotation of said one of the elements relative to the hub.

11. A pitch adjusting assembly as claimed in claim 10, said one of the elements defining a plurality of pitch notches, said spring pawl having a shiftable end adapted for receipt in one of said plurality of pitch notches, said shiftable end being shiftable to an adjacent one of said plurality of pitch notches when a sufficient torsional force is applied to the actuator.

12. A pitch adjusting assembly as claimed in claim 8, said actuator including a power actuator fixedly couplable to the hub and a rotatable drive shaft fixedly coupled to one of the elements.

13. A pitch adjusting assembly as claimed in claim 12, said power actuator being a servomotor.

14. A pitch adjusting assembly as claimed in claim 13; and a control unit adapted to be located remotely from the hub, said control unit operable to control the rotation of the drive shaft.

15. A variable pitch fan blade assembly comprising:

a rotatable hub;

a pitch-adjusting assembly supported by the hub, said pitch adjusting assembly including a first element rotatable relative to the hub on a first axis and a second element rotatable relative to the hub on a second axis, said first element presenting an elongated pitch pin, said second element defining an elongated pitch slot for receiving the pitch pin so that rotation of one of the elements causes rotation of the other of the elements;

said pin extending at least substantially parallel to one of the axes, said slot elongated at least substantially parallel to the other of the axes, a fan blade coupled to one of the elements; and an actuator coupled to the other of the elements, said actuator coupled to the hub for rotation therewith, said actuator at least partially rotatable relative to the hub on one of the first or second axes.

16. A variable pitch fan blade assembly as claimed in claim 15, said fan blade coupled to the hub for rotation therewith, said fan blade rotatable relative to the hub on the other of the first or second axes on which the actuator is not rotatable.

17. A variable pitch fan blade assembly as claimed in claim 16, said first and second axes being substantially perpendicular to one another.

18. A variable pitch fan blade assembly as claimed in claim 17, said pitch slot and said pitch pin being offset relative to the first and second axes.

19. A variable pitch fan blade assembly as claimed in claim 18, said pitch slot at least partially defined by a pair of opposing substantially parallel edges, said edges spaced to at least substantially prevent relative edgewise movement of the pitch pin within the pitch slot.

20. A variable pitch fan blade assembly as claimed in claim 16, said actuator manually rotatable relative to the hub.

21. A variable pitch fan blade assembly as claimed in claim 20; and a plurality of pitch notches on a surface of one of the elements; and a spring pawl having a first end fixedly coupled to the hub and a second end received in one of said plurality of pitch notches, said spring pawl providing resistance to rotation of said one of the elements, said spring pawl shiftable between the plurality of notches by rotating the actuator.

22. A variable pitch fan blade assembly as claimed in claim 16, said actuator including a motor fixedly coupled to the hub and a rotatable drive shaft fixedly coupled to said other of the elements.

23. A variable pitch fan blade assembly as claimed in claim 22; and a control unit located remotely from the variable pitch fan blade assembly, said control unit operable to control the rotation of the drive shaft.

24. A variable pitch fan blade assembly comprising:

a hub adapted for rotation on a hub axis, said hub having a housing and a pitch wheel disposed within the housing, said housing adapted to rotate on the hub axis, said pitch wheel adapted to rotate relative to the housing on a pitch wheel axis, said pitch wheel presenting an outer radial surface defining a slot; and a fan blade pivotally coupled to the hub, said fan blade adapted to rotate with the housing around the hub axis, said fan blade further adapted to rotate relative to the housing on a blade axis which is at least substantially perpendicular to the hub axis, said fan blade presenting a protruding pitch pin offset relative to the blade axis, said pitch pin extending at least substantially parallel to the blade axis, said pitch pin received in the slot in the pitch wheel, said fan blade being rotated on the blade axis when said pitch wheel is rotated relative to the housing, thereby adjusting the pitch of the fan blade.

25. A variable pitch fan blade assembly as claimed in claim 24, said fan blade having a base and a vane, said base adapted to rotate on the blade axis, said base having a first end coupled to the vane and a second end coupled to the pitch pin, said housing having a shaft-receiving opening for receiving the base, said base rotatable within the shaft-receiving opening.

26. A variable pitch fan blade assembly as claimed in claim 24, said pitch wheel having a plurality of slots for receiving a plurality of the pitch pins presented by a plurality of fan blades, when said pitch wheel is rotated relative to the housing the pitch of the plurality of the fan blades are simultaneously adjusted.

27. A variable pitch fan blade assembly as claimed in claim 24, said hub axis and said pitch wheel axis having substantially the same orientation.

28. A variable pitch fan blade assembly as claimed in claim 24, said pitch wheel selectively rotatable on the pitch wheel axis.

29. A variable pitch fan blade assembly as claimed in claim 24, said pitch wheel manually rotatable relative to the housing.

30. A variable pitch fan blade assembly as claimed in claim 29; and a plurality of pitch notches on a surface of the pitch wheel; and a spring pawl having a first end fixedly coupled to the housing and a second end received in one of said plurality of pitch notches, said spring pawl providing resistance to rotation of the pitch wheel relative to the housing, said spring pawl sufficiently flexible so that when a sufficient torsional force is applied to the pitch wheel the spring pawl deforms to allow the second end to be shifted out of one of said plurality of pitch notches and into an adjacent one of said plurality of pitch notches, thereby incrementally changing and holding the pitch of the fan blade.

31. A variable pitch fan blade assembly as claimed in claim 24; and a power actuator fixedly coupled to the housing, said power actuator having a rotatable drive shaft fixedly coupled to the pitch wheel.

32. A variable pitch fan blade assembly as claimed in claim 31; and a control unit located remotely from the variable pitch fan blade assembly, said control unit operable to control the rotation of the drive shaft.

33. A variable pitch fan blade assembly as claimed in claim 32, said drive shaft, said pitch wheel, and said hub sharing a common axis of rotation.

34. A method of simultaneously varying the pitch of a plurality of fan blades using an actuator, said method comprising the steps of:

(a) coupling a fan blade to a first element rotatable on a first axis;

(b) coupling an actuator to a second element rotatable on a second axis;

(c) inserting an elongated pin presented by one of the elements and extending at least substantially parallel to one of the axes into an elongated slot presented by the other of the elements;

(d) positioning the first and second elements so that the first and second axes are at least substantially perpendicular to one another; and (e) actuating the actuator to rotate the second element and thereby cause rotation of the blade.

35. A method as claimed in claim 34, step (e) including manually applying a torsional force to the actuator.

36. A method as claimed in claim 34; and (f) coupling a motor of the power actuator to a hub; and (g) coupling a drive shaft of the power actuator to the second element.

37. A method as claimed in claim 36, step (e) including rotating the drive shaft.

38. A method as claimed in claim 37; and (h) rotating the housing.

39. A method as claimed in claim 38, step (e) performed simultaneously with step (h).

* * * * *